United States Patent [19]

Middleton

[11] 3,989,411

[45] Nov. 2, 1976

[54] SILENCING VANE FOR TOROIDAL BLOWER

[75] Inventor: Andrew Henry Middleton, Southampton, England

[73] Assignee: British Gas Corporation, England

[22] Filed: July 14, 1975

[21] Appl. No.: 595,743

[52] U.S. Cl. ..... 415/213 T

[51] Int. Cl.[2] ..... F04D 5/00

[58] Field of Search ..... 415/119, 213 T, 53 T, 415/198 T, 199 T

[56] References Cited

UNITED STATES PATENTS

| | | | |
|---|---|---|---|
| 353,994 | 12/1886 | Walker et al. | 415/119 |
| 3,899,266 | 8/1975 | Masai | 415/53 T |

FOREIGN PATENTS OR APPLICATIONS

| | | | |
|---|---|---|---|
| 448,450 | 8/1927 | Germany | 415/53 T |
| 501,663 | 7/1930 | Germany | 415/213 T |
| 876,285 | 5/1953 | Germany | 415/213 T |
| 902,074 | 1/1954 | Germany | 415/213 T |
| 84,248 | 1/1957 | Netherlands | 415/53 T |

*Primary Examiner*—Henry F. Raduazo
*Attorney, Agent, or Firm*—Larson, Taylor and Hinds

[57] ABSTRACT

A peripheral blower of the kind having a toroidal chamber which is divided along a plane at right angles to its axis into a chamber part bounded by a stator housing having adjacent inlet and outlet ports with a stripper between them, and a chamber part bounded by a rotor housing containing a series of impeller blades, characterized in that the stripper block has a central cross-section corresponding to the cross-section of the hemi-toroidal stator in which it is fixed, and also two shaped vanes projecting one from each end of the block and extending in opposite directions around the toroidal chamber so that they at least partially cover the inlet and outlet ports, the thickness of each vane gradually diminishing from its root connection with the block to its free tip end. The blower is further characterized in that the stator housing is provided with passages which lead to and from the inlet and outlet ports respectively, the center lines of which are directed substantially along the directions of the helical path of the air-flow at the respective ports.

8 Claims, 11 Drawing Figures

Figure 1:
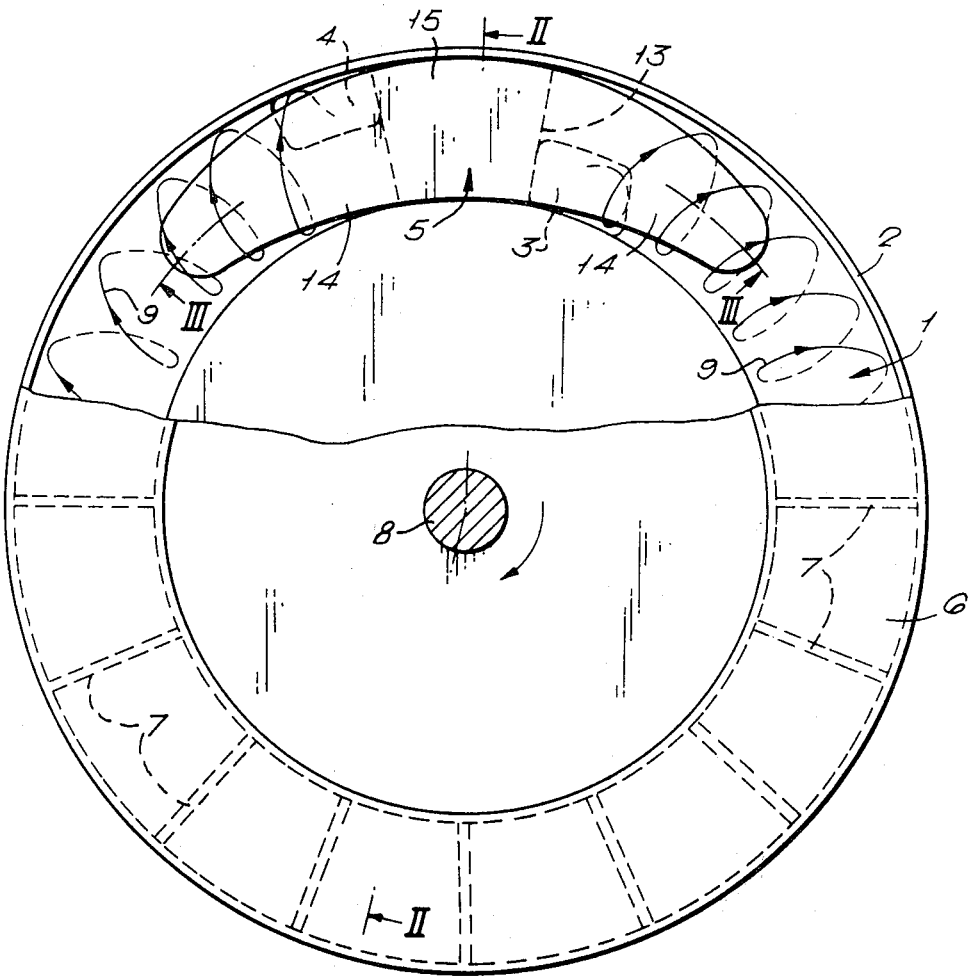

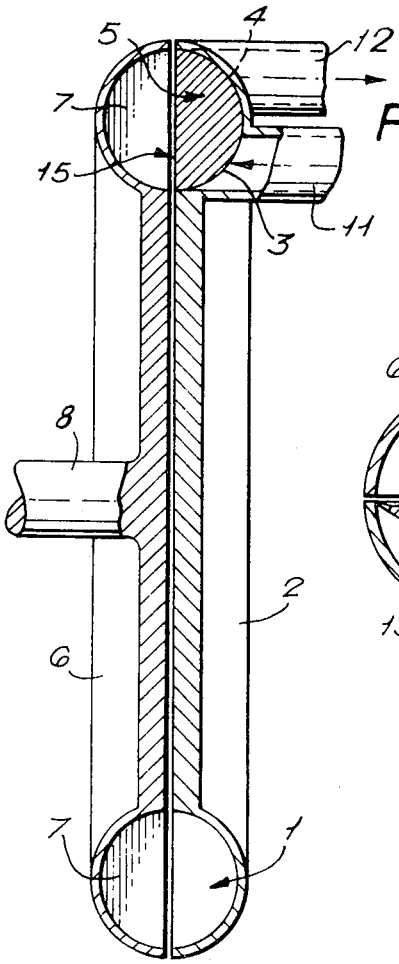
FIG. 2.
FIG. 4a.
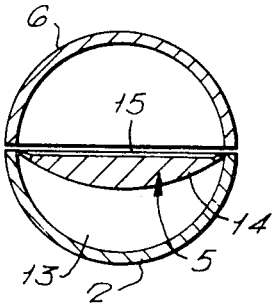
FIG. 4b.
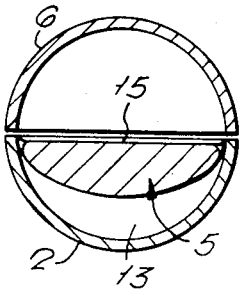
FIG. 4c.
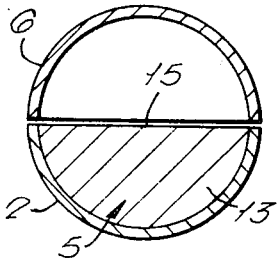
FIG. 3.
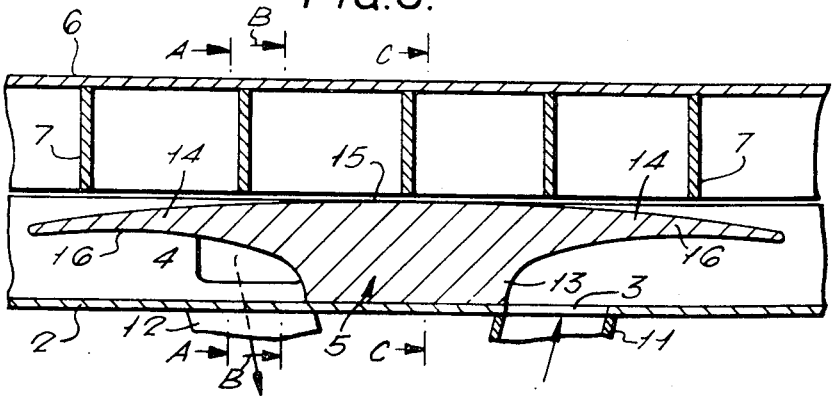

SILENCING VANE FOR TOROIDAL BLOWER

This invention relates to peripheral blowers of the kind (hereinafter referred to as the kind specified) comprising a toroidal chamber which is divided along a plane at right angles to its axis into a part bounded by a stator housing having adjacent inlet and outlet ports with a stripper block between them and a part bounded by a rotor housing containing a series of impeller blades. The impeller blades and the stripper are arranged in such a way that when the rotor housing is rotated a flow of air is induced into the chamber through the inlet port along a helical path, the axis of which extends around the toroidal chamber, and out of the chamber through the outlet port.

We have found that noise is generated at blade passing frequency as a result of the interaction of the air contained between the moving blades and the stationary stripper. We have also found that some of the noise normally produced by a conventional blower is caused by a sudden change of direction of air flow entering and leaving the toroidal chamber at the inlet and outlet ports. An object of the present invention is to provide an improved form of peripheral toroidal blower less subject to these disadvantages.

According to one aspect of the present invention, in a peripheral toroidal blower of the kind specified, the stripper consists of a solid block part whose central cross-section corresponds to the cross-section of the hemi-toroidal stator in which it is fixed, and two shaped vanes projecting one from each end of the block part and arranged to extend in opposite directions around the toroidal chamber so that they at least partially cover the inlet and outlet ports respectively but are spaced therefrom, the width of each vane gradually diminishing from its root connection with the block part of the stripper to its free tip end.

It will be appreciated that by increasing the time taken for the moving blades to pass from the main part of the toroid across the region of the stripper, the noise generated therebetween will be considerably reduced. Since the blade speed is constant, and fixed by the rotational speed of the blower this increase in time is achieved, in accordance with the invention, by lengthening and suitably shaping the stripper thereby effectively increasing the arcuate angle over which the moving blades "engage" with the stripper.

According to another aspect of the invention, the stator housing of a blower of this kind is provided with passages which lead to and from the inlet and outlet ports respectively, and the centre lines of which are directed substantially along the directions of the helical path of the air flow at the respective ports.

Thus, with this arrangement of the air inlet and outlet passages, the air flows in through the inlet port and out through the outlet port without any substantial change of direction at the planes of the ports. We have discovered that by directing the passages in this way, the noise produced by the blower is reduced very substantially below the noise level of such a blower with conventionally arranged inlet and outlet passages with which there is a sudden change of the direction of air flow at the ports.

The reduction of noise is of very considerable significance in many applications of the blower, but it is of particular importance when the blower is incorporated in a central heating system at the noise produced by the blower tends to be transmitted into the living spaces which are heated.

Preferably, the centre line of the inlet port and of the inlet passage leading to it is situated near the inner periphery of the toroidal chamber, and the centre line of the outlet port and of the passage leading from it is situated near the outer periphery of the chamber. Thus, the helical path of the air starts at the inside of the chamber and the air is urged centrifugally outwards at the start of its flow through the chamber and the air flows out of the chamber at the outermost part of its helical path.

Figure 5:
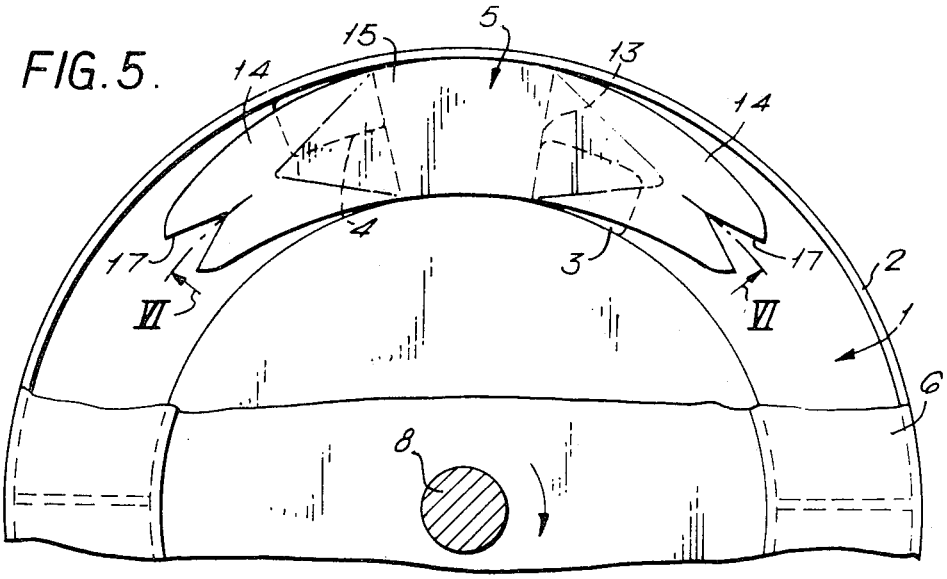
Figure 6:
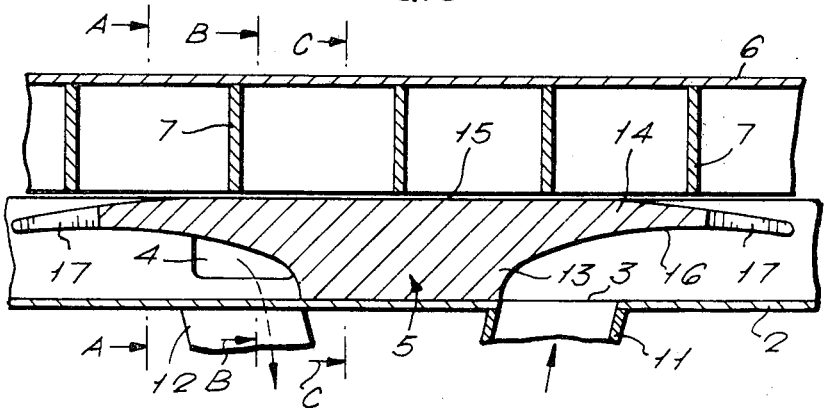
Figure 7A:
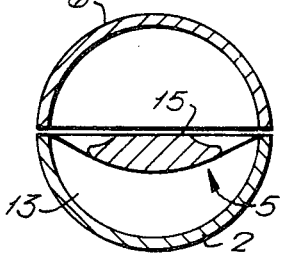
Figure 7B:
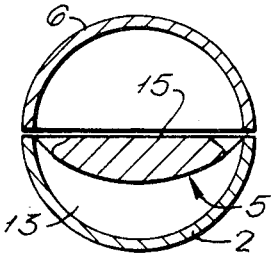
Figure 7C:
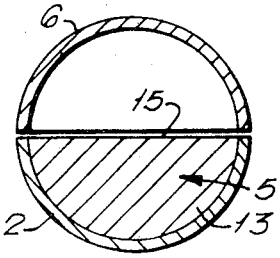

The invention will now be further described by way of example with reference to the accompanying diagrammatic drawings in which:

FIG. 1 is an end elevation, partly broken away, of a peripheral toroidal blower according to one embodiment of the invention, FIG. 2 is a sectional side elevation on the line II–II of FIG. 1, FIG. 3 is an enlarged developed fragmentary sectional plan on the line III—III of FIG. 1 but including the rotor, FIGS. 4*a*, 4*b* and 4*c* are sections on the lines A–A, B–B and C–C respectively of FIG. 3, FIG. 5 is a fragmentary end elevation of the stator housing similar to the top portion of FIG. 1 but showing a modified form of stripper, FIG. 6 is an enlarged developed fragmentary sectional plan on the line VI-VI of FIG. 5 but including the rotor, and FIG. 7*a*, 7*b* and 7*c* are sections on the lines A—A, B—B and C—C respectively of FIG. 6.

Referring first to FIGS. 1–4 of the drawing, a peripheral blower suitable for use, for example in a central space heating system, comprising a toroidal chamber 1 divided along a plane at right angles to its axis into a chamber part bounded by a stator housing 2 having adjacent inlet and outlet ports 3 and 4 respectively with a stripper block 5 of a non-porous material located between, and a chamber part bounded by a rotor housing 6 containing a plurality of fixed radially extending impeller blades 7. The impeller blades 7 and stripper 5 are arranged such that, upon rotation of the rotor housing 6 by a drive shaft 8, a flow of air is induced into the toroidal chamber through the inlet port 3 along a substantially helical path indicated at 9 in FIG. 1 (the axis of which extends around the toroidal chamber) and out of the chamber through the outlet port 4, the stripper block 5 preventing recirculation.

The stator housing 2 is provided with an inlet passage in the form of a duct 11 communicating with the inlet port 3 and an outlet passage in the form of a duct 12 communicating with the outlet port 4, the ports and ducts preferably being of rectangular cross-section, but they may alternatively be of circular or other cross-section instead.

Both the inlet duct 11 and the outlet 12 preferably extend laterally from the stator housing 2 in a direction away from the rotor housing 6 for ease of connection of further inlet and outlet ducts if these are necessary.

The stripper 5 is formed by a central block 13, arranged to be a snug fit in stator housing 2, and two curved vanes 14 extending one from each end of the block 13 so as almost to cover the inlet and outlet ports respectively. Each vane 14 is preferably shaped such that its thickness and width gradually diminishes from its root connection with the block 13 towards its radiused tip.

Preferably, the stripper is formed with a central flat region 15 in a plane at right angles to the axis of the blower and closely adjacent to the blade edges.

Preferably also, each vane curves away slightly from the plane of the blade edges, and its surface 16 remote from the blades is curved to merge with its root connection with the central block 13 so as to provide a smooth passage for flow of air from and to the inlet and outlet ports 11, 12 and 13 respectively.

The vanes of the stripper may be formed from sheet material attached to the top of a conventional stripper block which has been suitably shaped and reduced in height to accommodate the thickness of the vane. Preferably however the stripper is formed from non-porous material of sufficient mechanical strength, for example, diecast metal or moulded plastics material.

The stripper performs the function of separating the inlet and outlet ports, as in a conventional peripheral blower, by having a close clearance to the blades over the flat central area 15, but by virtue of the tapering space through which the spirally circulating air has to flow as it enters and leaves the rotor, the impulsive pressure changes previously experienced with such conventional blowers are greatly reduced, with a consequent substantial reduction in blade passing frequency noises.

Referring now to FIGS. 5–7, a further reduction of noise in the blower just described can be achieved by providing the tip of each stripper vane with notch, for example, a V-shaped notch 17. Furthermore, the boundary of the central flat region 15 terminating on each vane is defined by a line substantially V-shaped, the apex of the vee pointing towards the respective notched vane tip.

In the examples shown, the air flow in the chamber follows a path 9 which is a more or less true helix extending toroidally. Then the inlet duct 11 extends at an angle to a diametric plane which includes the axis of rotation of the blower and which passes through the centre line of the inlet port 3 and extends from this plane in a direction towards the outlet port 4 (see FIGS. 3 and 6). The outlet duct 12 extends at a similar inclination in a direction towards the inlet port 3 so that the two ducts 11 and 12 extend towards each other, but are offset from each other in a radial direction from the axis of rotation of the rotor, that is to say, the inlet duct 11 extends from near the inner periphery of the stator housing 2, and the outlet duct extends from near the outer periphery thereof (see FIG. 2). With this arrangement, the centre lines of the inlet and outlet ports are directed substantially along the directions of the helical path of the air flow at the respective port with a resultant reduction of noise level usually associated with conventional blowers.

If the impeller blades are inclined to radii of the stator housing however, the helical path along which air flow takes place becomes distorted with the turns of the helix leaning forwards in the direction of rotation of the rotor. In this case, the inlet and outlet ducts become more nearly parallel to each other and indeed may be exactly parallel.

I claim:

1. A peripheral toroidal blower of the kind comprising a toroidal chamber which is divided along a plane at right angles to its axis into a part bounded by a stator housing having adjacent inlet and outlet ports with a stripper block disposed between them and a part bounded by a rotor housing containing a series of impeller blades, characterized in that the stripper block comprises a solid block part whose central cross-section corresponds to the cross-section of the hemi-toroidal stator in which the stripper block is disposed, and two shaped vanes projecting one from each end of the block part and extending in opposite directions around the toroidal chamber so that said vanes at least partially cover the inlet and outlet ports respectively end, are spaced therefrom and said vanes having face tip ends the width of each vane gradually diminishing from its root connection with the block part of the stripper block to its free tip end.

2. A peripheral toroidal blower according to claim 1, characterized in that the thickness of each vane gradually diminishes from its root connection with the block part of the stripper block to its free tip end.

3. A peripheral toroidal blower according to claim 2, characterized in that each vane is curved so as to merge smoothly with its gradually diminishing radially inner and outer edges.

4. A peripheral toroidal blower according to claim 2, characterized in that the tip end of each vane is notched.

5. A peripheral toroidal blower according to claim 1, characterized in that the stripper block is formed with a central flat region in a plane at right angles to the axis of the blower and closely adjacent the blade edges, and further characterized in that each vane is curved slightly away from the plane of this flat region.

6. A peripheral toroidal blower according to claim 5, charaterized in that the surface of each vane remote from the blades is curved and merges at its root with the block part so as to provide a smooth wall passage for the flow of air from and to the inlet and outlet ports respectively.

7. A peripheral blower according to claim 1, characterized in that the stator housing is provided with passages which lead to and from the inlet and outlet ports respectively, the center lines of said passages being directed substantially in the directions of the helical path of the air flow at the respective ports.

8. A peripheral blower according to claim 7, characterized in that the center line of the inlet port and the inlet passage leading to it is situated near the inner periphery of the toroidal chamber, and the center line of the outlet port and of the passage leading from it is situated near the outer periphery of the chamber.

* * * * *